US010583676B2

(12) United States Patent
Yamamura et al.

(10) Patent No.: US 10,583,676 B2
(45) Date of Patent: Mar. 10, 2020

(54) LIQUID JET HEAD AND LIQUID JET RECORDING DEVICE

(71) Applicant: SII Printek Inc., Chiba-shi, Chiba (JP)

(72) Inventors: Yuki Yamamura, Chiba (JP); Masaru Midorikawa, Chiba (JP); Naohiro Tomita, Chiba (JP); Shunsuke Yamazaki, Chiba (JP); Shuji Sato, Chiba (JP)

(73) Assignee: SII PRINTEK INC., Chiba (JP)

( * ) Notice: Subject to any disclaimer, the term of this patent is extended or adjusted under 35 U.S.C. 154(b) by 0 days.

(21) Appl. No.: 16/176,648

(22) Filed: Oct. 31, 2018

(65) Prior Publication Data

US 2019/0126650 A1 May 2, 2019

(30) Foreign Application Priority Data

Nov. 2, 2017 (JP) ..... 2017-212879

(51) Int. Cl.
*B41J 2/14* (2006.01)
*B41J 29/377* (2006.01)
*B41J 2/175* (2006.01)

(52) U.S. Cl.
CPC ..... *B41J 29/377* (2013.01); *B41J 2/14233* (2013.01); *B41J 2/175* (2013.01); *B41J 2002/14354* (2013.01)

(58) Field of Classification Search
CPC ..... B41J 29/377; B41J 2/14233; B41J 2/175; B41J 2002/14354; B41J 2/03; B41J 2/04531; B41J 2/04538; B41J 2/0454; B41J 2/04553; B41J 2/055; B41J 2/04565; B41J 2/04563; B41J 2/1408
See application file for complete search history.

(56) References Cited

FOREIGN PATENT DOCUMENTS

| | | |
|---|---|---|
| JP | S59-209881 | 11/1984 |
| JP | S62-193835 | 8/1987 |
| JP | 2016-165873 A | 9/2016 |

OTHER PUBLICATIONS

Extended European Search Report for European Application No. 18203131.0, dated Mar. 8, 2019, 8 pages.

*Primary Examiner* — Kristal Feggins
(74) *Attorney, Agent, or Firm* — Brinks Gilson & Lione

(57) ABSTRACT

A liquid jet head and a liquid jet recording device capable of accurately detecting the temperature of the ink are provided. A liquid jet head according to an embodiment of the disclosure includes a flow channel member provided with a flow channel of a liquid, and having a high heat conduction part disposed so as to have contact with the liquid flowing inside the flow channel, and a low heat conduction part having lower thermal conductivity than thermal conductivity of the high heat conduction part, a temperature detection element disposed outside the flow channel, and attached to the high heat conduction part, and a liquid jet section from which the liquid is jetted.

7 Claims, 10 Drawing Sheets

LIQUID JET HEAD AND LIQUID JET RECORDING DEVICE

RELATED APPLICATIONS

This application claims priority under 35 U.S.C. § 119 to Japanese Patent Application No. 2017-212879 filed on Nov. 2, 2017, the entire content of which is hereby incorporated by reference.

BACKGROUND OF THE INVENTION

1. Field of the Invention

The present disclosure relates to a liquid jet head and a liquid jet recording device.

2. Description of the Related Art

As one of liquid jet recording devices, there is provided an inkjet type recording device for ejecting (jetting) ink (liquid) on a recording target medium such as recording paper to perform recording of images, characters, and so on.

In the liquid jet recording device of this type, it is arranged that the ink is supplied from an ink tank to an inkjet head (a liquid jet head), and then the ink is ejected from nozzle holes of the inkjet head toward the recording target medium to thereby perform recording of the images, the characters, and so on.

In the inkjet type recording device, there is performed the temperature control of the ink ejected from a nozzle hole (see, e.g., JP-A-562-193835 (PLT 1)). This is because the viscosity of the ink changes with the temperature. The viscosity of the ink affects the ejection speed.

In such an inkjet type recording device, it is required to accurately detect the temperature of the ink ejected from the nozzle hole. Therefore, it is desirable to provide the liquid jet head and the liquid jet recording device capable of accurately detecting the temperature of the ink.

SUMMARY OF THE INVENTION

A liquid jet head according to an embodiment of the disclosure includes a flow channel member provided with a flow channel of a liquid, and having a high heat conduction part disposed so as to have contact with the liquid flowing inside the flow channel, and a low heat conduction part having lower thermal conductivity than thermal conductivity of the high heat conduction part, a temperature detection element disposed outside the flow channel, and attached to the high heat conduction part, and a liquid jet section from which the liquid is jetted.

A liquid jet recording device according to an embodiment of the disclosure is equipped with the liquid jet head according to an embodiment of the disclosure.

According to the liquid jet head and the liquid jet recording device related to an embodiment of the disclosure, it becomes possible to accurately detect the temperature of the ink.

DETAILED DESCRIPTION OF THE PREFERRED EMBODIMENTS

An embodiment of the present disclosure will hereinafter be described in detail with reference to the drawings.

1. EMBODIMENT

[Overall Configuration of Printer 1]

Figure 1:
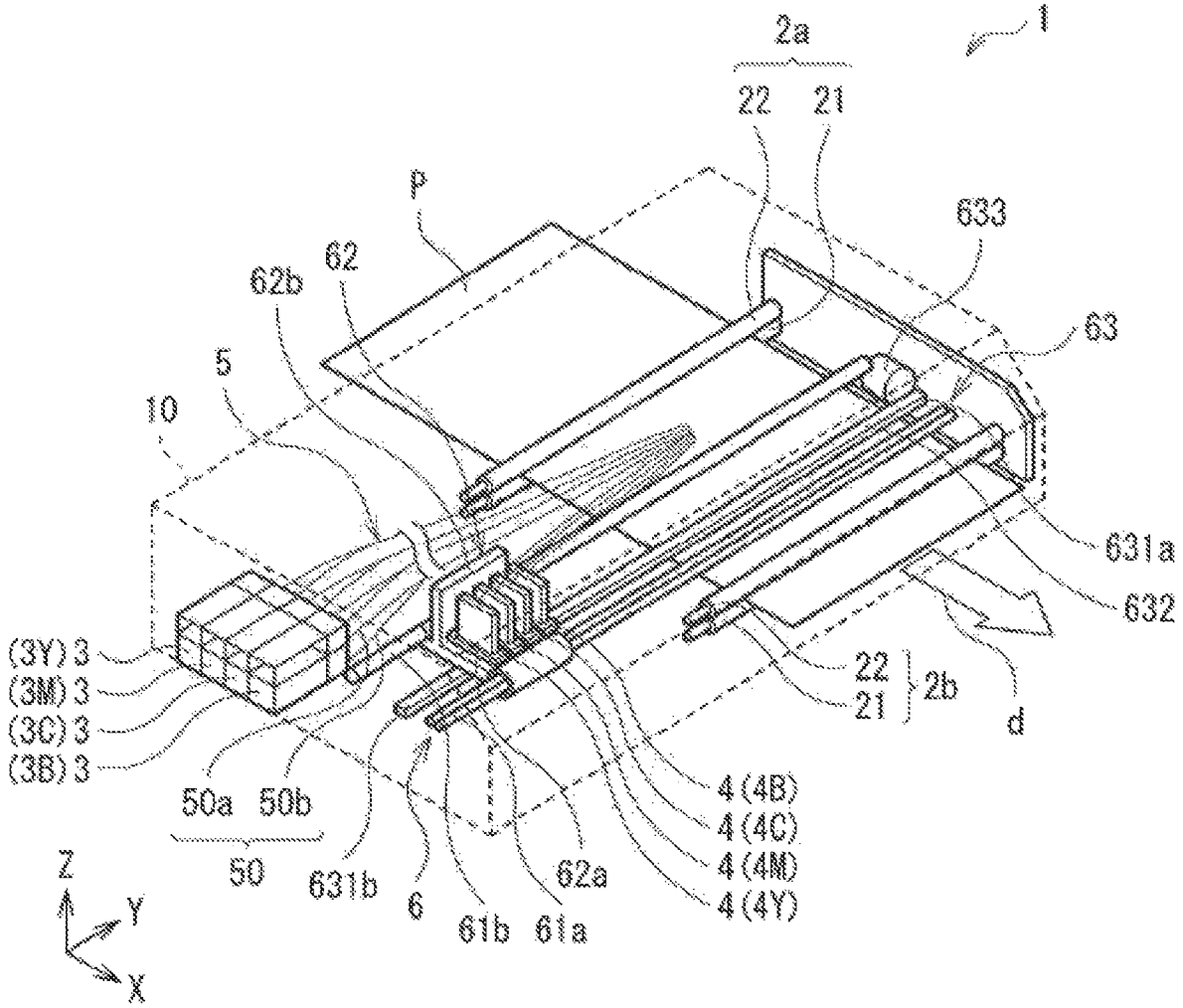
FIG. 1 is a schematic perspective view showing a schematic configuration example of a liquid jet recording device according to an embodiment of the disclosure.

FIG. 1 is a perspective view schematically showing a schematic configuration example of a printer 1 as a liquid jet recording device according to one embodiment of the present disclosure. The printer 1 is an inkjet printer for performing recording (printing) of images, characters, and so on, on recording paper P as a recording target medium using ink 9 described later.

As shown in FIG. 1, the printer 1 is provided with a pair of carrying mechanisms 2*a*, 2*b*, ink tanks 3, inkjet heads 4, a circulation mechanism 5, and a scanning mechanism 6. These members are housed in a housing 10 having a predetermined shape. It should be noted that the scale size of each member is accordingly altered so that the member is shown large enough to recognize in the drawings used in the description of the specification.

Here, the printer 1 corresponds to a specific example of the "liquid jet recording device" in the present disclosure, and the inkjet heads 4 (the inkjet heads 4Y, 4M, 4C, and 4B described later) each correspond to a specific example of the "liquid jet head" in the present disclosure. Further, the ink 9 corresponds to a specific example of the "liquid" in the present disclosure.

The carrying mechanisms 2*a*, 2*b* are each a mechanism for carrying the recording paper P along the carrying direction d (an X-axis direction) as shown in FIG. 1. These carrying mechanisms 2*a*, 2*b* each have a grit roller 21, a pinch roller 22 and a drive mechanism (not shown). The grit roller 21 and the pinch roller 22 are each disposed so as to extend along a Y-axis direction (the width direction of the recording paper P). The drive mechanism is a mechanism for rotating (rotating in a Z-X plane) the grit roller 21 around an axis, and is constituted by, for example, a motor.

(Ink Tanks 3)

The ink tanks 3 are each a tank for containing the ink 9 inside. As the ink tanks 3, there are disposed 4 types of tanks for individually containing 4 colors of ink 9, namely yellow (Y), magenta (M), cyan (C), and black (B), in this example as shown in FIG. 1. Specifically, there are disposed the ink tank 3Y for containing the yellow ink 9, the ink tank 3M for containing the magenta ink 9, the ink tank 3C for containing the cyan ink 9, and the ink tank 3B for containing the black ink 9. These ink tanks 3Y, 3M, 3C, and 3B are arranged side by side along the X-axis direction inside the housing 10.

It should be noted that the ink tanks 3Y, 3M, 3C, and 3B have the same configuration except the color of the ink 9 contained, and are therefore collectively referred to as ink tanks 3 in the following description.

(Inkjet Heads 4)

The inkjet heads 4 are each a head for jetting (ejecting) the ink 9 having a droplet shape from a plurality of nozzles (nozzle holes H1) described later to the recording paper P to thereby perform printing of images, characters, and so on. As the inkjet heads 4, there are also disposed 4 types of heads for individually jetting the 4 colors of ink 9 respectively contained by the ink tanks 3Y, 3M, 3C, and 3B described above in this example as shown in FIG. 1. Specifically, there are disposed the inkjet head 4Y for jetting the yellow ink 9, the inkjet head 4M for jetting the magenta ink 9, the inkjet head 4C for jetting the cyan ink 9, and the inkjet head 4B for jetting the black ink 9. These inkjet heads 4Y, 4M, 4C, and 4B are arranged side by side along the Y-axis direction inside the housing 10.

Figure 3:
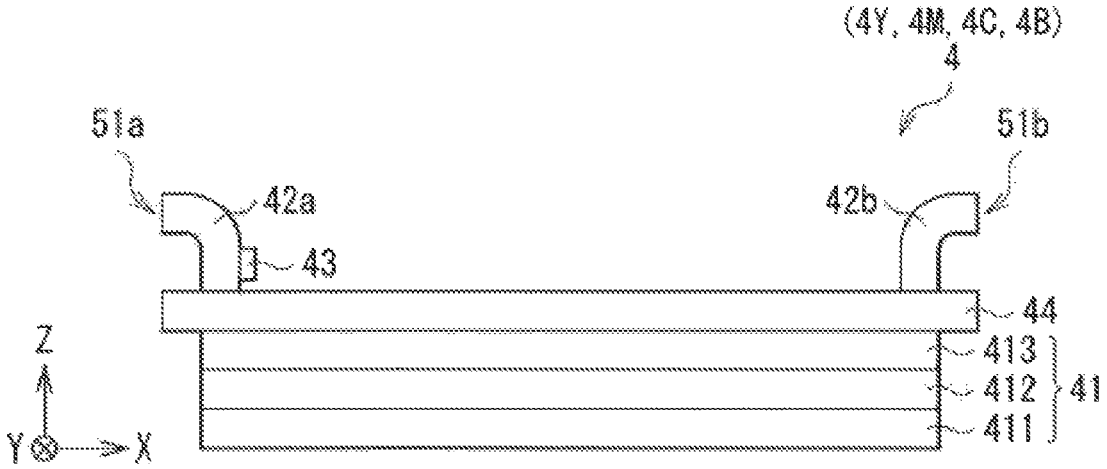
FIG. 3 is a schematic side view showing a configuration of the inkjet head shown in FIG. 1.

It should be noted that the inkjet heads 4Y, 4M, 4C, and 4B have the same configuration except the color of the ink 9 used, and are therefore collectively referred to as inkjet heads 4 in the following description. Further, the detailed configuration of the inkjet heads 4 will be described later in detail (FIG. 3).

(Circulation Mechanism 5)

The circulation mechanism 5 is a mechanism for circulating the ink 9 between the inside of the ink tanks 3 and the inside of the inkjet heads 4, and is configured including circulation channels 50 of the ink 9.

Figure 2:
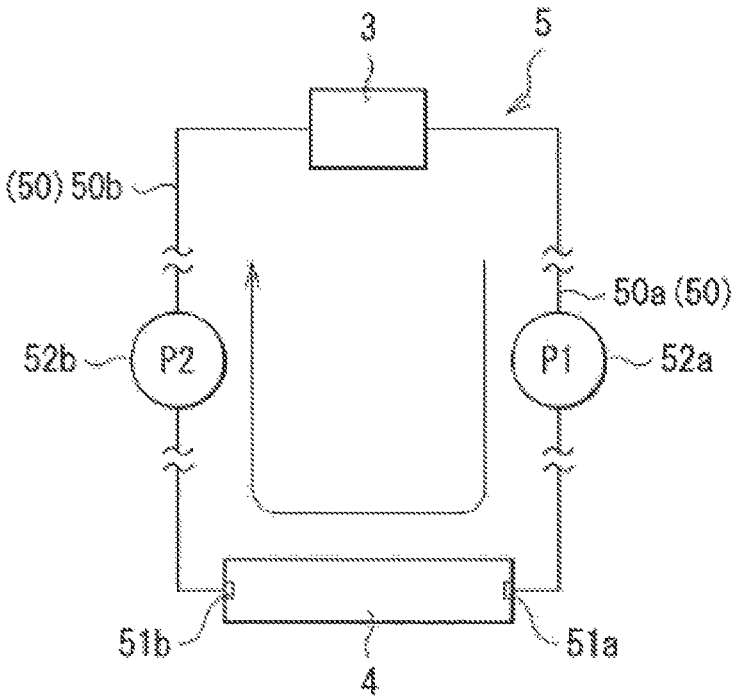
FIG. 2 is a block diagram schematically showing a circulation mechanism shown in FIG. 1.

FIG. 2 schematically shows a configuration of the circulation mechanism 5. The circulation channels 50 of the circulation mechanism 5 each have, for example, a flow channel 50*a* as a part extending from the ink tank 3 to the inkjet head 4, and a flow channel 50*b* extending from the inkjet head 4 to the ink tank 3. In other words, the flow channel 50*a* is a flow channel through which the ink 9 flows from the ink tank 3 toward the inkjet head 4. Further, the flow channel 50*b* is a flow channel through which the ink 9 flows from the inkjet head 4 toward the ink tank 3. The flow channel 50*a* is communicated with an introduction port 51*a* of the inkjet head 4, and it is arranged that the ink 9 flowing through the flow channel 50*a* is introduced to the inkjet head 4 via the introduction port 51*a*. The flow channel 50*b* is communicated with a discharge port 51*b* of the inkjet head 4, and it is arranged that the ink 9 is discharged from the inkjet head 4 to the flow channel 50*b* via the discharge port 51*b*. The flow channels 50*a*, 50*b* (supply tubes of the ink 9) are each formed of a flexible hose having flexibility.

The circulation mechanism 5 has pressure pumps 52*a* and suction pumps 52*b*. The pressure pump 52*a* is a pump provided to the flow channel 50*a* and for pressurizing the inside of the flow channel 50*a* to deliver the ink 9 to the inkjet head 4. The suction pump 52*b* is provided to the flow channel 50*b*, and depressurizing the inside of the flow channel 50*b* to suction the ink 9 from the inkjet head 4.

(Scanning Mechanism 6)

The scanning mechanism 6 is a mechanism for making the inkjet heads 4 perform a scanning operation along the width direction (the Y-axis direction) of the recording paper P. As shown in FIG. 1, the scanning mechanism 6 has a pair of guide rails 61*a*, 61*b* disposed so as to extend along the Y-axis direction, a carriage 62 movably supported by these guide rails 61*a*, 61*b*, and a drive mechanism 63 for moving the carriage 62 along the Y-axis direction. Further, the drive mechanism 63 is provided with a pair of pulleys 631*a*, 631*b* disposed between the pair of guide rails 61*a*, 61*b*, an endless belt 632 wound between the pair of pulleys 631*a*, 631*b*, and a drive motor 633 for rotationally driving the pulley 631*a*.

The pulleys 631*a*, 631*b* are respectively disposed in areas corresponding to the vicinities of both ends in each of the guide rails 61*a*, 61*b* along the Y-axis direction. To the endless belt 632, there is connected the carriage 62. The carriage 62 has a pedestal 62*a* having a plate-like shape for mounting the four types of inkjet heads 4Y, 4M, 4C, and 4B described above, and a wall section 62*b* erected vertically (in the Z-axis direction) from the pedestal 62*a*. On the pedestal 62*a*, the inkjet heads 4Y, 4M, 4C, and 4B are arranged side by side along the Y-axis direction.

It should be noted that it is arranged that a moving mechanism for moving the inkjet heads 4 relatively to the recording paper P is constituted by such a scanning mechanism 6 and the carrying mechanisms 2*a*, 2*b* described above.

[Detailed Configuration of Inkjet Heads 4]

Then, the detailed configuration example of the inkjet heads 4 will be described with reference to FIG. 3 in addition to FIG. 1. FIG. 3 is a diagram schematically showing a cross-sectional configuration example (a Z-X cross-sectional view) of the inkjet head 4.

The inkjet heads 4 according to the present embodiment are each, for example, an inkjet head of a so-called side-shoot type for ejecting the ink 9 from a central part in the extending direction (the Y-axis direction) of a plurality of channels (channels C1 described later. Further, the inkjet heads 4 are each an inkjet head of a circulation type which uses the circulation mechanism 5 (the circulation channel 50) described above to thereby use the ink 9 while circulated between the inkjet head 4 and the ink tank 3.

The inkjet head 4 is provided with a head chip 41, flow channel members 42*a*, 42*b*, a temperature detection element 43 and a flow channel plate 44. It should be noted that the head chip 41 and the flow channel plate 44 correspond to a specific example of a "liquid jet section" in the present disclosure.

(Head Chip 41)

The head chip 41 is a member for jetting the ink 9 along the Z-axis direction, and is configured using a variety of types of plates described below.

Figure 4:
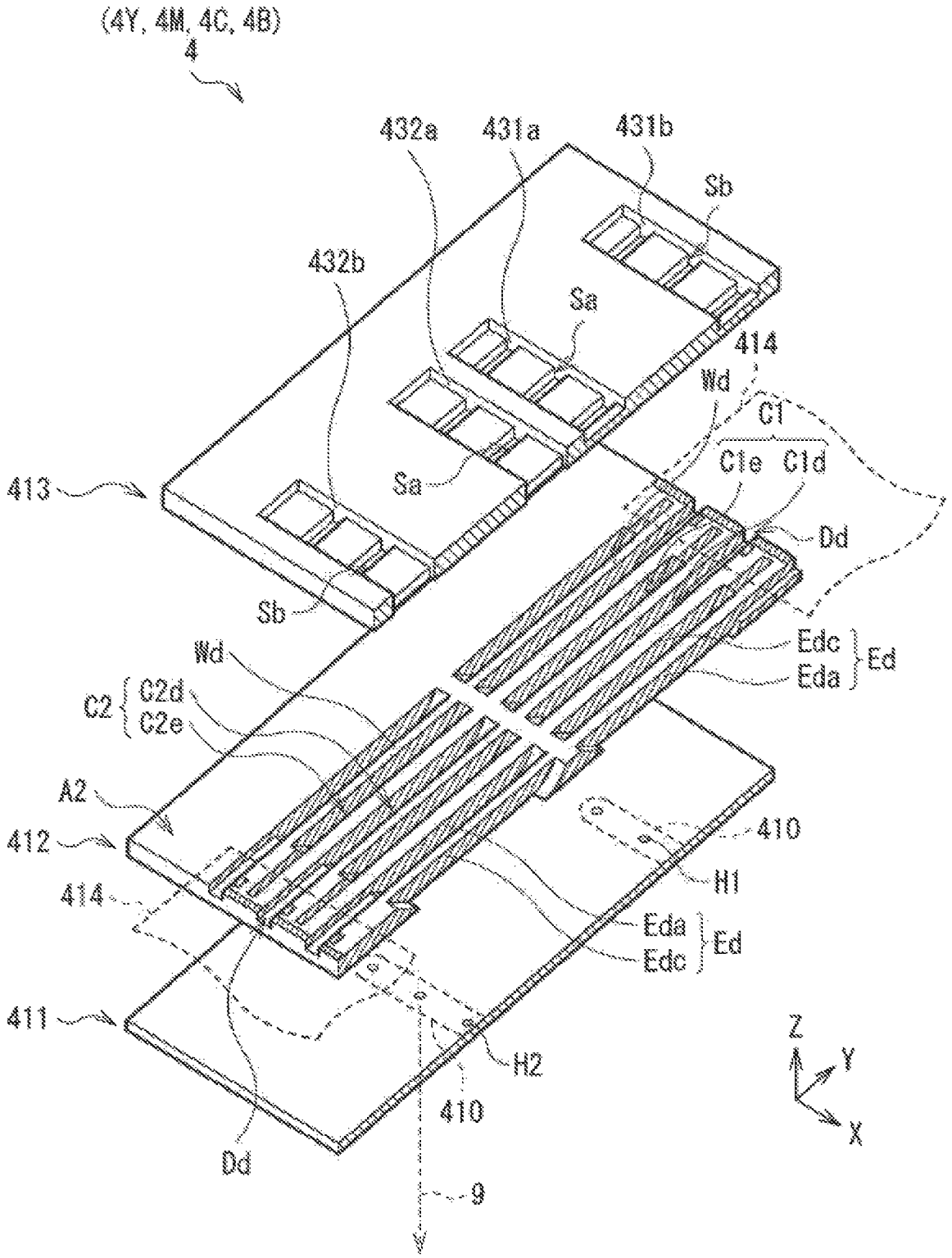
FIG. 4 is a perspective view showing respective configurations of the nozzle plate, the actuator plate, and the cover plate shown in FIG. 3.
Figure 5:
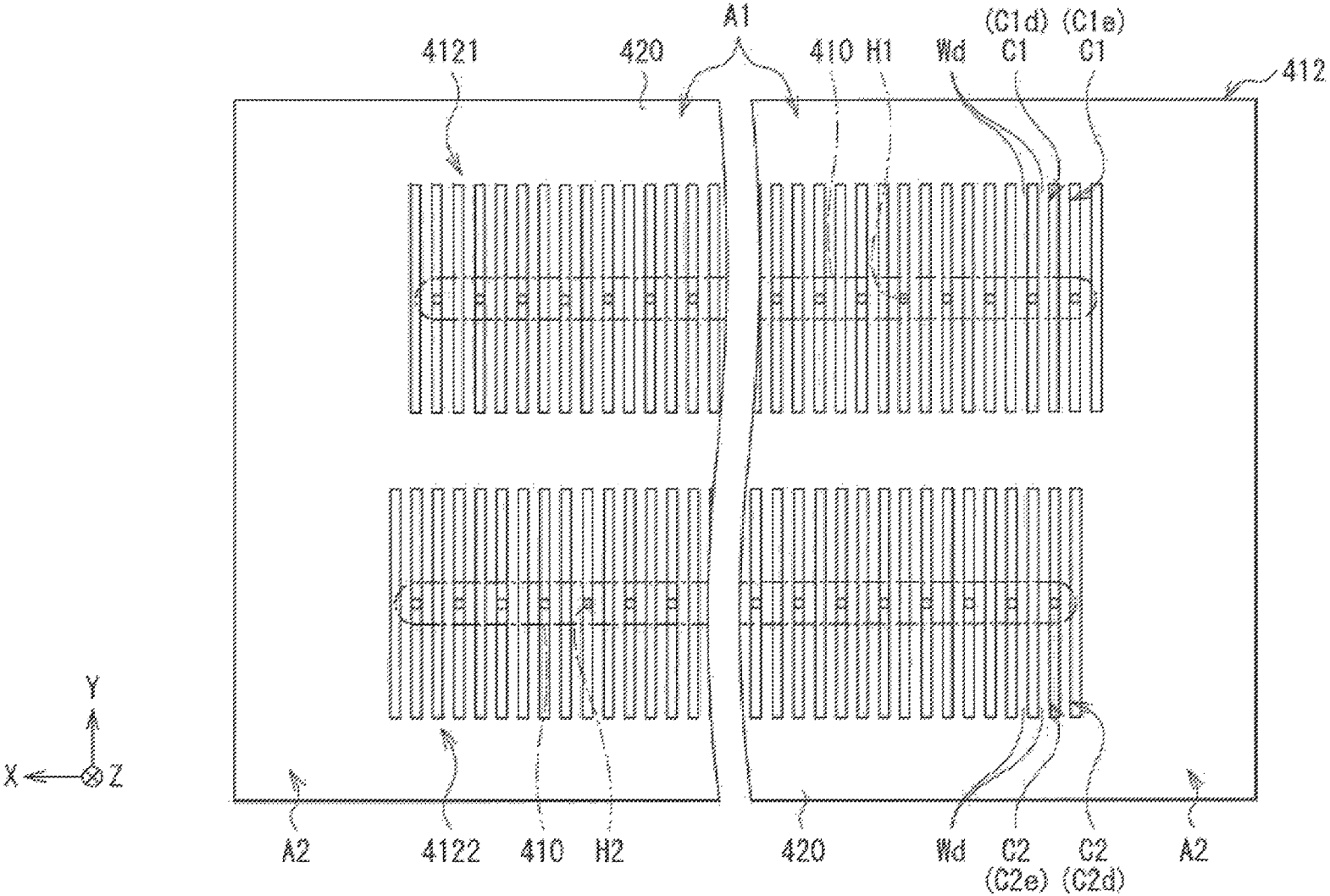
FIG. 5 is a plan view showing the configuration of the actuator plate shown in FIG. 4.

FIG. 4 is an exploded perspective view of the head chip 41 shown in FIG. 3, and FIG. 5 is a bottom view (an X-Y bottom view) schematically showing a configuration example of the inkjet head 4 in the state in which a nozzle plate 411 (described later) shown in FIG. 4 is detached. The head chip 41 is mainly provided with a nozzle plate (a jet hole plate) 411, an actuator plate 412 and a cover plate 413. The head chip 41 is stacked on the flow channel plate 44, and the nozzle plate 411, the actuator plate 412 and the cover plate 413 are arranged in this order with the nozzle plate 411 being the farthest from the flow channel plate 44. The nozzle plate 411, the actuator plate 412 and the cover plate 413 are bonded to each other using, for example, an adhesive, and are stacked on one another in this order along the Z-axis direction.

(Nozzle Plate 411)

The nozzle plate 411 is formed of, for example, a metal material, and has a thickness of about 50 μm. As shown in FIG. 3, the nozzle plate 411 is bonded to a lower surface of the actuator plate 412 with an adhesive layer (not shown). Further, as shown in FIG. 4, the nozzle plate 411 is provided with two nozzle columns 410 each extending along the X-axis direction. The two nozzle columns 410 are arranged along the Y-axis direction at a predetermined distance. As described above, the inkjet head 4 of the present embodiment is formed as a tow-column type inkjet head.

One of the nozzle columns 410 has a plurality of nozzle holes H1 formed in alignment with each other at predetermined intervals along the X-axis direction. These nozzle holes H1 each penetrate the nozzle plate 411 along the thickness direction (the Z-axis direction) of the nozzle plate 411, and are communicated with, for example, the respective ejection channels C1*e* in the actuator plate 412 described later. Specifically, as shown in FIG. 4, each of the nozzle holes H1 is formed so as to be located in a central part along the Y-axis direction on the ejection channel C1*e*. Further, the formation pitch along the X-axis direction in the nozzle holes H1 is arranged to be equal (to have an equal pitch) to the formation pitch along the X-axis direction in the ejection channels C1*e*. Although the details will be described later, it is arranged that the ink 9 supplied from the inside of the ejection channel C1*e* is ejected (jetted) from each of the nozzle holes H1 in such a nozzle column 410.

The other of the nozzle columns 410 similarly has a plurality of nozzle holes H2 formed in alignment with each other at predetermined intervals along the X-axis direction. Each of these nozzle holes H2 also penetrates the nozzle plate 411 along the thickness direction of the nozzle plate 411, and is communicated with the ejection channel C2*e* in the actuator plate 412 described later. Specifically, as shown in FIG. 4, each of the nozzle holes H2 is formed so as to be located in a central part along the Y-axis direction on the ejection channel C2*e*. Further, the formation pitch along the X-axis direction in the nozzle holes H2 is arranged to be equal to the formation pitch along the X-axis direction in the ejection channels C2*e*. Although the details will be described later, it is arranged that the ink 9 supplied from the inside of the ejection channel C2*e* is also ejected from each of the nozzle holes H2 in such a nozzle column 410.

It should be noted that such nozzle holes H1, H2 are each formed as a tapered through hole gradually decreasing in diameter toward the lower side.

(Actuator Plate 412)

The actuator plate 412 is a plate formed of a piezoelectric material such as lead zirconate titanate (PZT). The actuator plate 412 is formed by, for example, stacking two piezoelectric substrates different in polarization direction in the Z-axis direction on one another (a so-called chevron type). It is also possible to form the actuator plate 412 with a single piezoelectric substrate having the polarization direction set to one direction along the thickness direction (the Z-axis direction) (a so-called cantilever type). Further, as shown in FIG. 5, the actuator plate 412 is provided with two channel columns (channel columns 4121, 4122) each extending along the X-axis direction. These channel columns 4121, 4122 are arranged along the Y-axis direction at a predetermined distance.

In such an actuator plate 412, as shown in FIG. 5, an ejection area (jetting area) A1 of the ink 9 is disposed in a central part (the formation areas of the channel columns 4121, 4122) along the X-axis direction. On the other hand, in the actuator plate 412, a non-ejection area (a non-jetting area) A2 of the ink 9 is disposed in each of the both end parts (non-formation areas of the channel columns 4121, 4122) along the X-axis direction. The non-ejection areas A2 are located on the outer side along the X-axis direction with respect to the ejection area A1. It should be noted that the both end parts along the Y-axis direction in the actuator plate 42 each constitute a tail part 420.

As shown in FIG. 4 and FIG. 5, the channel column 4121 described above has the plurality of channels C1 extending along the Y-axis direction. These channels C1 are arranged side by side so as to be parallel to each other at predetermined intervals along the X-axis direction. Each of the channels C1 is partitioned with drive walls Wd formed of a piezoelectric body (the actuator plate 412), and forms a groove section having a recessed shape in a cross-sectional view (see FIG. 4).

The channel column 4122 similarly has the plurality of channels C2 extending along the Y-axis direction. These channels C2 are arranged side by side so as to be parallel to each other at predetermined intervals along the X-axis direction. Each of the channels C2 is also partitioned with the drive walls Wd described above, and forms a groove section having a recessed shape in a cross-sectional view.

Here, as shown in FIG. 4 and FIG. 5, in the channels C1, there exist the ejection channels C1*e* for ejecting the ink 9, and dummy channels C1*d* not ejecting the ink 9. In the channel column 4121, the ejection channels C1*e* and the dummy channels C1*d* are alternately arranged along the X-axis direction. Each of the ejection channels C1*e* is communicated with the nozzle hole H1 in the nozzle plate 411 on the one hand, but each of the dummy channels C1*d* is not communicated with the nozzle hole H1, and is covered with the upper surface of the nozzle plate 411 from below on the other hand.

Similarly, in the channels C2, there exist the ejection channels C2*e* for ejecting the ink 9, and dummy channels C2*d* not ejecting the ink 9. In the channel column 4122, the ejection channels C2*e* and the dummy channels C2*d* are alternately arranged along the X-axis direction. Each of the ejection channels C2*e* is communicated with the nozzle hole H2 in the nozzle plate 411 on the one hand, but each of the dummy channels C2*d* is not communicated with the nozzle hole H2, and is covered with the upper surface of the nozzle plate 411 from below on the other hand.

Further, as shown in FIG. 5, the ejection channels C1*e* and the dummy channels C1*d* in the channels C1 and the ejection channels C2*e* and the dummy channels C2*d* in the channels C2 are arranged in a staggered manner. Therefore, in each of the inkjet heads 4 according to the present embodiment, the ejection channels C1*e* in the channels C1 and the ejection channels C2*e* in the channels C2 are arranged in a zigzag manner. It should be noted that as shown in FIG. 4, in the actuator plate 412, in the part corresponding to each of the dummy channels C1*d*, C2*d*, there is formed a shallow groove section Dd communicated with an outside end part extending along the Y-axis direction in the dummy channel C1*d*, C2*d*.

Here, as shown in FIG. 4, the drive electrode Ed extending along the Y-axis direction is disposed on each of the inside surfaces opposed to each other in the drive walls Wd described above. As the drive electrodes Ed, there exist common electrodes Edc disposed on the inner side surfaces facing the ejection channels C1*e*, C2*e*, and active electrodes Eda disposed on the inner side surfaces facing the dummy channels C1*d*, C2*d*. It should be noted that each of such drive electrodes Ed (the common electrodes Edc and the active electrodes Eda) is formed in the entire area in the depth direction (the Z-axis direction) on the inner side surface of the drive wall Wd.

The pair of common electrodes Edc opposed to each other in the same ejection channel C1*e* (or the same ejection channel C2*e*) are electrically connected to each other in a common terminal (not shown). Further, the pair of active electrodes Eda opposed to each other in the same dummy channel C1*d* (or the same dummy channel C2*d*) are electrically separated from each other. In contrast, the pair of active electrodes Eda opposed to each other via the ejection channel C1*e* (or the ejection channel C2*e*) are electrically connected to each other in an active terminal (not shown).

Here, as shown in FIG. 4, in the tail part 420 described above, there is mounted a flexible printed circuit board 414 for electrically connecting the drive electrodes Ed and a control section (not shown) in the inkjet head 4 to each other. Interconnection patterns (not shown) provided to the flexible printed circuit board 414 are electrically connected to the common terminals and the active terminals described above. Thus, it is arranged that the drive voltage is applied to each of the drive electrodes Ed from the control section via the flexible printed circuit board 414.

(Cover Plate 413)

The cover plate 413 is disposed so as to close the channels C1, C2 (the channel columns 4121, 4122) in the actuator plate 412. Specifically, the cover plate 413 is bonded to the upper surface of the actuator plate 412, and has a plate-like structure.

As shown in FIG. 4, the cover plate 413 is provided with a pair of entrance side common ink chambers 431*a*, 432*a* and a pair of exit side common ink chambers 431*b*, 432*b*. Specifically, the entrance side common ink chamber 431*a* and the exit side common ink chamber 431*b* are each formed in an area corresponding to the channel column 4121 (the plurality of channels C1) in the actuator plate 412. Further, the entrance side common ink chamber 432*a* and the exit side common ink chamber 432*b* are each formed in an area corresponding to the channel column 4122 (the plurality of channels C2) in the actuator plate 412.

The entrance side common ink chamber 431*a* is formed in the vicinity of an inner end part along the Y-axis direction in each of the channels C1, and forms a groove section having a recessed shape. In areas corresponding respectively to the ejection channels C1*e* in the entrance side common ink chamber 431*a*, there are respectively formed supply slits Sa penetrating the cover plate 413 along the thickness direction (the Z-axis direction) of the cover plate 413. Similarly, the entrance side common ink chamber 432*a* is formed in the vicinity of an inner end part along the Y-axis direction in each of the channels C2, and forms a groove section having a recessed shape. In this entrance side common ink chamber 432*a*, the supply slit Sa described above is also formed in an area corresponding to each of the ejection channels C2*e*.

As shown in FIG. 4, the exit side common ink chamber 431*b* is formed in the vicinity of an outer end part along the Y-axis direction in each of the channels C1, and forms a groove section having a recessed shape. In areas corresponding respectively to the ejection channels C1*e* in the exit side common ink chamber 431*b*, there are respectively formed discharge slits Sb penetrating the cover plate 413 along the thickness direction of the cover plate 413. Similarly, the exit side common ink chamber 432*b* is formed in the vicinity of an outer end part along the Y-axis direction in each of the channels C2, and forms a groove section having a recessed shape. In this exit side common ink chamber 432*b*, the discharge slit Sb described above is also formed in an area corresponding to each of the ejection channels C2*e*.

In such a manner, the entrance side common ink chamber 431*a* and the exit side common ink chamber 431*b* are each communicated with the ejection channel C1*e* via the supply slit Sa and the discharge slit Sb on the one hand, but are not communicated with the dummy channels C1*d* on the other hand. Specifically, each of the dummy channels C1*d* is arranged to be closed by bottom parts of the entrance side common ink chamber 431*a* and the exit side common ink chamber 431*b*.

Similarly, the entrance side common ink chamber 432*a* and the exit side common ink chamber 432*b* are each communicated with the ejection channel C2*e* via the supply slit Sa and the discharge slit Sb on the one hand, but are not communicated with the dummy channels C2*d* on the other hand. Specifically, each of the dummy channels C2*d* is arranged to be closed by bottom parts of the entrance side common ink chamber 432*a* and the exit side common ink chamber 432*b*.

(Flow Channel Plate 44)

Figure 6:
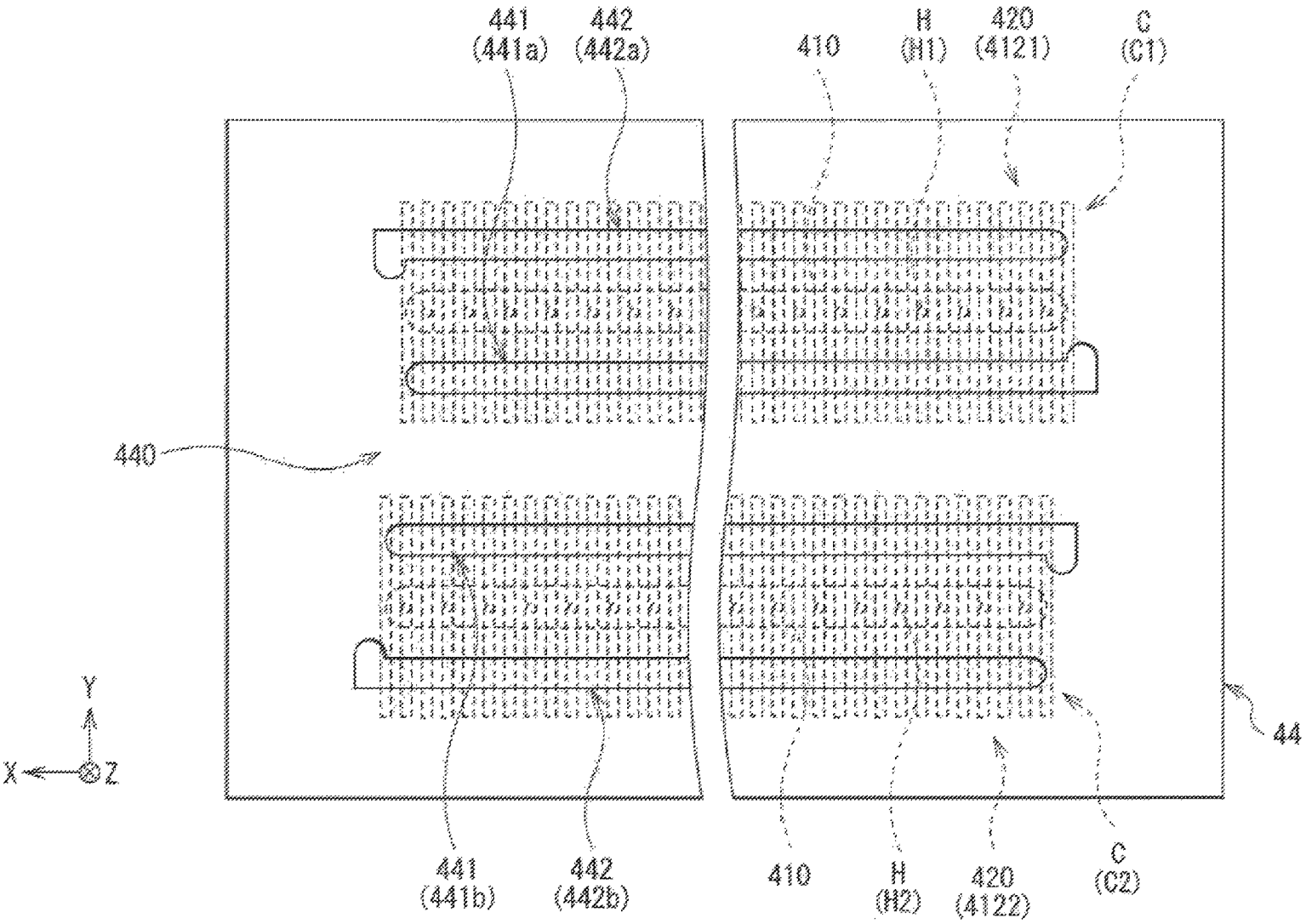
FIG. 6 is a plan view showing a configuration of the flow channel plate shown in FIG. 3.

FIG. 6 shows a planar configuration of the flow channel plate 44 shown in FIG. 3.

It should be noted that in FIG. 6, the plurality of nozzle holes H (H1, H2), the two nozzle columns 410, the plurality of channels C (C1, C2) and the channel columns (4121, 4122) are represented by the dotted lines in order to make the positional relationship between the nozzle plate 411 and the flow channel plate 44 easy to understand.

The flow channel plate 44 has flow channels 440 of the ink 9 to be supplied to the plurality of channels C as shown in, for example, FIG. 6. The flow channels 440 are penetrating grooves for transmitting the ink 9, and extend in the same direction (the X-axis direction) as the extending direction of the channel columns 4121, 4122.

In particular, the flow channels 440 have, for example, a plurality of introduction flow channels 441 and a plurality of discharge flow channels 442 for transmitting the ink 9. Specifically, the flow channels 440 include, for example, the introduction flow channel 441*a* and the discharge flow channel 442*a* disposed at positions corresponding to the channel column 4121, and the introduction flow channel 441*b* and the discharge flow channel 442*b* disposed at positions corresponding to the channel column 4122. This is because even if pressure waves are generated due to the jet of the ink 9 in the plurality of channels C1 included in the channel column 4121, it becomes difficult for the pressure waves to propagate to the plurality of channels C2 included in the channel column 4122. Thus, the ink 9 is stably jetted from the plurality of nozzle holes H. Further, this is because the total amount (the circulation amount) of the ink 9 in the flow channels 440 becomes large. Thus, even the ink 9 high in viscosity is sufficiently and stably circulated.

The introduction flow channel 441*a* and the discharge flow channel 442*a* are disposed so as to overlap the channel column 4121. The introduction flow channel 441*a* is an introduction port for introducing the ink 9 into the plurality of channels C1, and at the same time, the discharge flow channel 442*a* is a discharge port for discharging the ink 9 from the plurality of channels C1. Therefore, the ink 9 is introduced into the plurality of channels C1 via the introduction flow channel 441*a*, and is then discharged from the plurality of channels C1 via the discharge flow channel 442*a*.

Since one of the nozzle columns 410 is disposed between the introduction flow channel 441*a* and the discharge flow channel 442*a*, the introduction flow channel 441*a* and the discharge flow channel 442*a* are separated from each other in the Y-axis direction via the nozzle column 410. The introduction flow channel 441*a* is disposed, for example, on the inner side of the discharge flow channel 442*a* in the Y-axis direction.

The introduction flow channel 441*b* and the discharge flow channel 442*b* are disposed so as to overlap the channel column 4122. The introduction flow channel 441*b* is an introduction port for introducing the ink 9 into the plurality of channels C2, and at the same time, the discharge flow channel 442*b* is a discharge port for discharging the ink 9 from the plurality of channels C2. Therefore, the ink 9 is introduced into the plurality of channels C2 via the introduction flow channel 441*b*, and is then discharged from the plurality of channels C2 via the discharge flow channel 442*b*.

Since the other of the nozzle columns 410 is disposed between the introduction flow channel 441*b* and the discharge flow channel 442*b*, the introduction flow channel 441*b* and the discharge flow channel 442*b* are separated from each other in the Y-axis direction via the nozzle column 410. The introduction flow channel 441*b* is disposed, for example, on the inner side of the discharge flow channel 442*b* in the Y-axis direction.

To the flow channels 440 provided to such a flow channel plate 44, there are connected the introduction port 51*a* and the discharge port 51*b* in the circulation mechanism 5 described above. Specifically, the introduction port 51*a* is connected to the introduction flow channels 441*a*, 441*b*, and the discharge part 51*b* is connected to the discharge flow channels 442*a*, 442*b*.

(Flow Channel Members 42*a*, 42*b*)

The flow channel members 42*a*, 42*b* are each, for example, a component shaped like a curved pipe, and are disposed on the flow channel plate 44. The flow channel member 42*a* is provided with the introduction port 51*a*, and a flow channel of the ink 9 between the introduction port 51*a* and the flow channel plate 44 (the introduction flow channels 441*a*, 441*b*). The flow channel member 42*b* is provided with a flow channel of the ink 9 between the flow channel plate 44 (the discharge flow channels 442*a*, 442*b*) and the discharge port 51*b*, and the discharge port 51*b*. In other words, the flow channel member 42*a* is a connection part of the flow channel extending from the flow channel 50*a* to the flow channel plate 44, and the flow channel member 42*b* is a connection part of the flow channel extending from the flow channel plate 44 to the flow channel 50*b*. It is arranged that the ink 9 flows inside (inside the flow channels) the flow channel members 42*a*, 42*b* each shaped like a pipe. To the flow channel member 42*a*, there is attached the temperature detection element 43.

Figure 7:
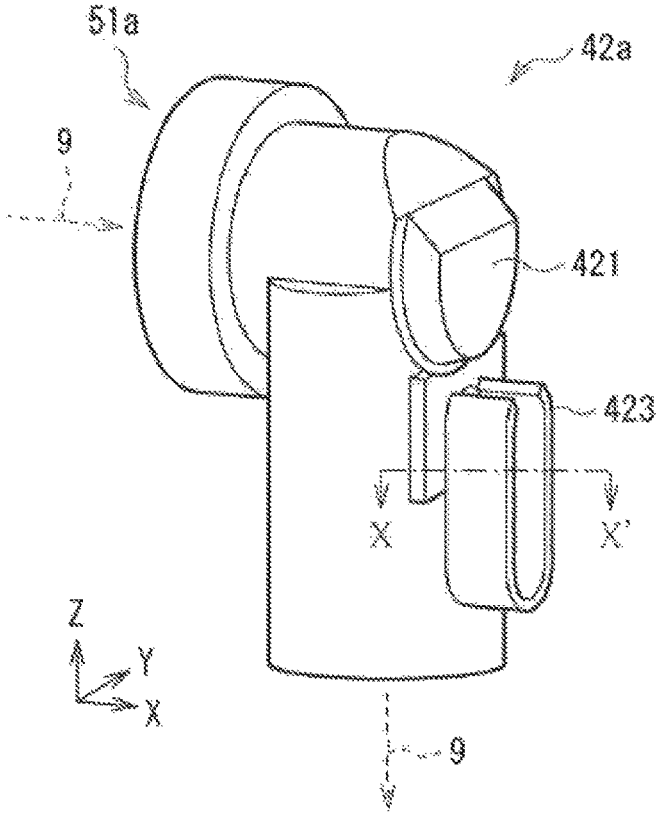
FIG. 7 is a perspective view schematically showing a configuration of the flow channel member shown in FIG. 3.
Figure 8:
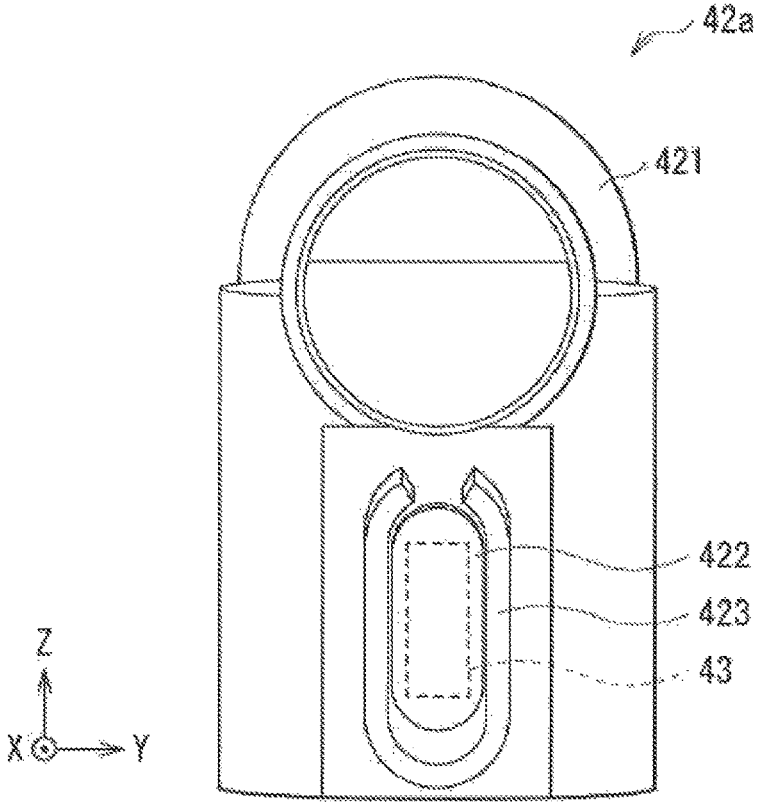
FIG. 8 is a back view schematically showing the configuration of the flow channel member shown in FIG. 7.
Figure 9:
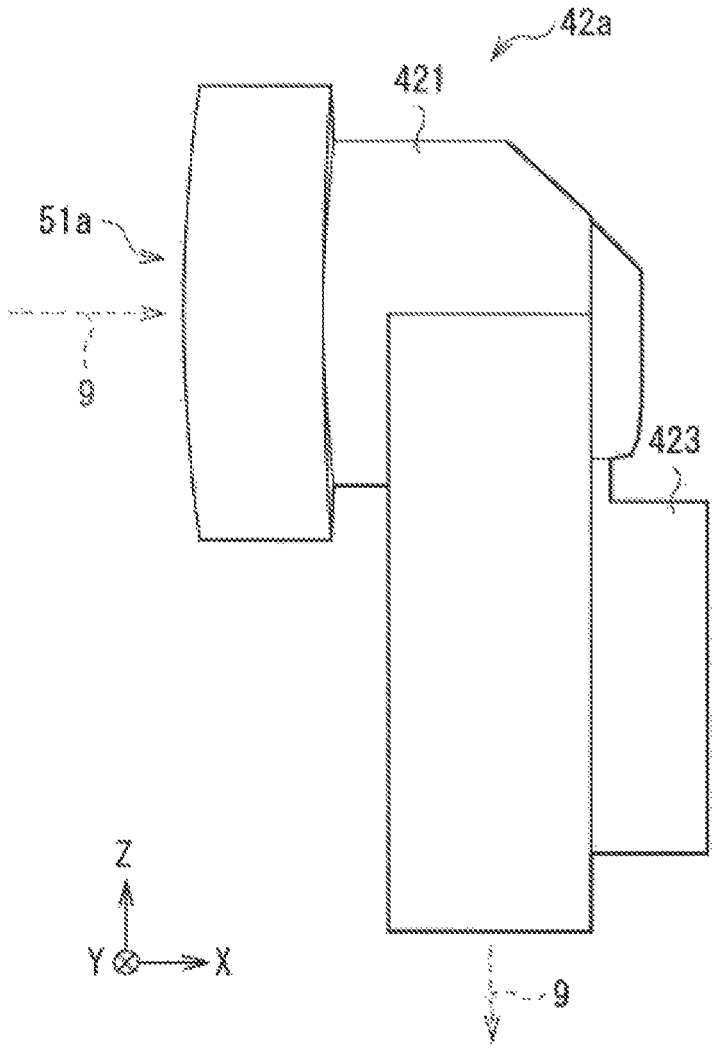
FIG. 9 is a side view schematically showing the configuration of the flow channel member shown in FIG. 7.

In FIG. 7 through FIG. 9, there is shown the configuration of the flow channel member 42*a* while indicating the installation place (the dotted lines in FIG. 8) of the temperature detection element 43. FIG. 7 is a perspective view showing the configuration of the flow channel member 42*a*. Here, a surface (a Y-Z plane) provided with the introduction port 51*a* of the flow channel member 42*a* is defined as a front surface, a surface opposed to the front surface is defined as a back surface, and surfaces (an X-Z plane) connecting the front surface and the back surface to each other are defined as side surfaces. FIG. 8 is a back view (a Y-Z back view) of the flow channel member 42*a*, and FIG. 9 is a side view (an X-Z side view) of the flow channel member 42*a*. For example, the ink 9 inflows into the introduction port 51*a* of the flow channel member 42*a* along the X-axis direction, flows inside (inside the flow channel member 42*a*) of the flow channel provided to the flow channel member 42*a*, and then outflows from the flow channel member 42*a* along the Z-axis direction.

The flow channel member 42*a* includes a low heat conduction part 421 and a high heat conduction part 422.

The low heat conduction part 421 constitutes a large portion of the flow channel member 42*a*. For example, the flow channel member 42*a* is constituted by the low heat conduction part 421 except a part (the high heat conduction part 422) of the back surface. The low heat conduction part 421 has low thermal conductivity than the thermal conductivity of the high heat conduction part 422. Thus, it is possible to suppress the heat radiation of the ink 9 flowing inside the flow channel member 42*a* while having contact with the low heat conduction part 421 to thereby keep the temperature of the ink 9. It is preferable for the material constituting the low heat conduction part 421 to be superior in workability. As the material for constituting the low heat conduction part 421, there can be cited a resin material such as PPS (poly phenylene sulfide).

The low heat conduction part 421 has a wall part 423 erected on the back surface of the flow channel member 42*a* to have a predetermined height (a size in the X-axis direction). The wall part 423 is disposed so as to have a roughly U shape surrounding the high head conduction part 422. Such a wall part 423 forms a pocket-like housing section in which the temperature detection element 43 is disposed. A bottom surface of this housing section corresponds to the high heat conduction part 422.

The high heat conduction part 422 has higher thermal conductivity than the conductivity of the low heat conduction part 421, and forms a part of the back surface of the flow channel member 42*a*. In order to suppress the heat radiation of the ink 9, it is preferable for the high heat conduction part 422 to be made as small as possible. The high heat conduction part 422 is surrounded by the wall part 423 of the low heat conduction part 421. The inner surface of the high heat conduction part 422 has contact with the ink 9 flowing inside the flow channel member 42*a*. In the present embodiment, the temperature detection element 43 is attached to an opposite surface to the surface having contact with the ink 9 of the high heat conduction part 422. In other words, the inner surface (the inside of the flow channel) of the high heat conduction part 422 has contact with the ink 9, and the temperature detection element 43 is attached to an outer surface (the outside of the flow channel) of the high heat conduction part 422. Therefore, the temperature detection element 43 detects the temperature of the ink 9 via the high heat conduction part 422. Although the detail will be described later, due to the above, it becomes possible to accurately detect the temperature of the ink 9 flowing inside the flow channel member 42*a*.

The material constituting the high heat conduction part 422 has contact with the ink 9, and is therefore preferably provided with corrosion resistance. As the material for constituting the high heat conduction part 422, there can be cited a metal material such as a stainless steel (SUS: steel use stainless) material or a titanium (Ti) material. It can be arrange that the high heat conduction part 422 is configured using a resin material such as nylon. It is preferable for the high head conduction part 422 to be integrally formed with the low heat conduction part 421. In the case in which the constituent material of the high heat conduction part 422 is different from the constituent material of the low heat conduction part 421, for example, the high heat conduction part 422 and the low heat conduction part 421 are formed in two colors. Thus, it becomes possible to improve the pressure resistance and the durability of the junction part between the high heat conduction part 422 and the low heat conduction part 421.

(Temperature Detection Element 43)

The temperature detection element 43 is disposed in the pocket-like housing section surrounded by the wall part 423, and is attached to the outer surface of the high heat conduction part 422. By disposing the temperature detection element 43 in the part surrounded by the wall part 423, the temperature detection element 43 is stably fixed. Since the wall part 423 is formed of the low heat conduction part 421, the detection temperature of the temperature detection element 43 becomes hard to be affected by the outside temperature of the wall part 423. The temperature detection element 43 is formed of, for example, a thermistor. The viscosity of the ink 9 changes with the temperature. Therefore, by performing the temperature management of the ink 9 using the temperature detection element 43, the viscosity of the ink 9 is adjusted, and thus, the ejection speed can be stabilized.

Figure 10:
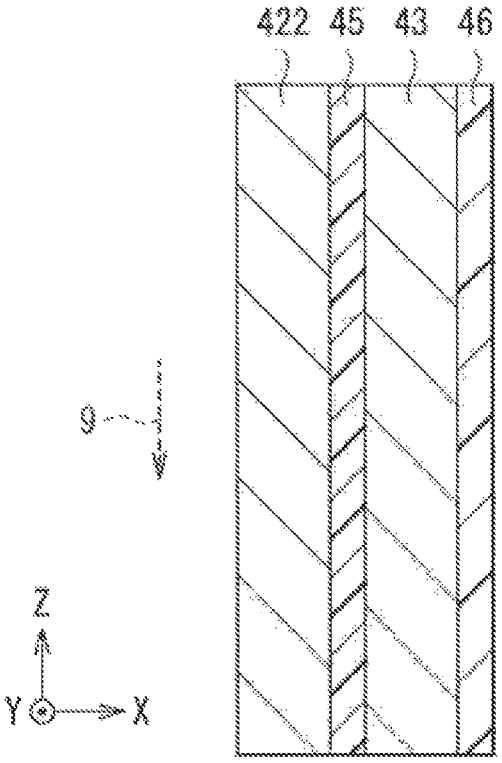
FIG. 10 is a diagram schematically showing a cross-sectional configuration along the line X-X' shown in FIG. 7.

FIG. 10 schematically shows a cross-sectional (X-Z cross-sectional) configuration along the line X-X' shown in FIG. 7. The temperature detection element 43 is fixed to the high heat conduction part 422 with a first adhesive 45, and other parts than the bonding surface to the high heat conduction part 422 of the temperature detection element 43 are covered with a second adhesive 46. The first adhesive 45 has thermal conductivity in the level of not hindering the heat conduction from the ink 9 to the temperature detection element 43 via the high heat conduction part 422. The first adhesive 45 is disposed in the pocket-like housing section surrounded by the wall part 423, and is therefore difficult to be leaked outside the wall part 423. It is preferable that between the temperature detection element 43 and the high heat conduction part 422, the first adhesive 45 is disposed alone, and no other components exist.

The second adhesive 46 is for suppressing the influence of the environmental temperature on the temperature detection element 43, and it is preferable for the thermal conductivity of the second adhesive 46 to be lower than the thermal conductivity of the first adhesive 45. It is sufficient for the second adhesive 46 to have contact with at least a part of the temperature detection element 43 other than the bonding surface with the high heat conduction part 422. As the first adhesive 45, it is possible to use, for example, a high thermal conductive silicon series adhesive, and as the second adhesive 46, it is possible to use, for example, an epoxy resin adhesive.

FIG. 11A through FIG. 11D are diagrams sequentially showing a method of attaching the temperature detection element 43 to the flow channel member 42*a*.

Figure 11A:
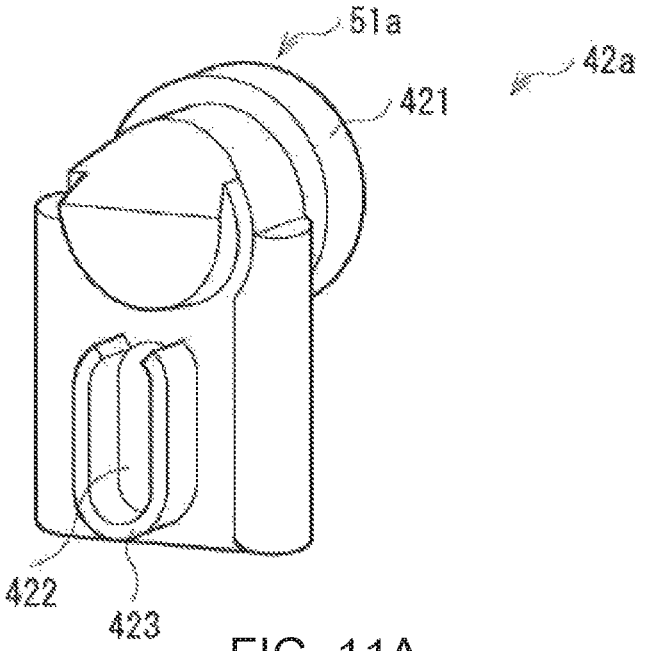
FIG. 11A is a perspective view showing a process of attaching a temperature detection element to the flow channel member shown in FIG. 7.

Firstly, as shown in FIG. 11A, there is formed the flow channel member 42*a* obtained by integrally forming the low heat conduction part 421 and the high heat conduction part 422 with each other. On the back surface of the flow channel member 42*a*, the wall part 423 surrounding the high heat conduction part 422 is formed in advance.

Figure 11B:
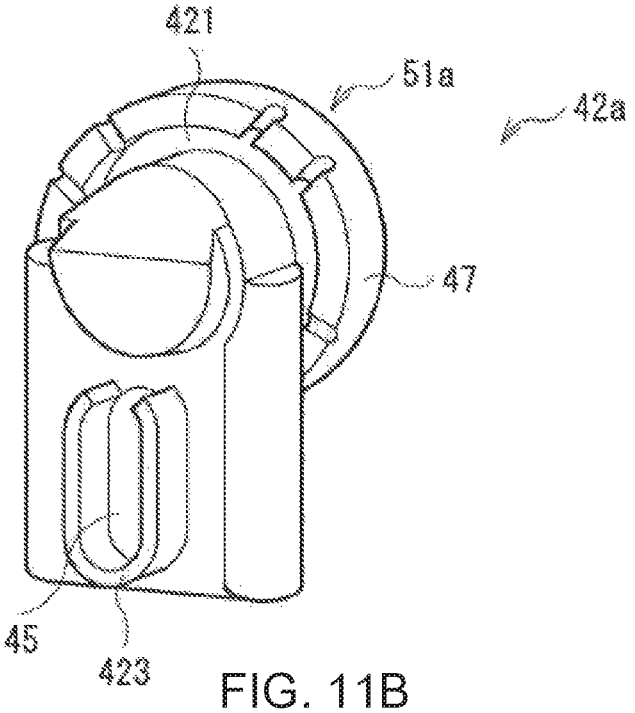
FIG. 11B is a cross-sectional view showing a process following the process shown in FIG. 11A.

Then, as shown in FIG. 11B, the first adhesive 45 is applied to the outer surface of the high heat conduction part 422. On this occasion, since the first adhesive 45 is applied inside the area surrounded by the wall part 423, leakage of the first adhesive 45 to the outside of the wall part 423 can be prevented. A connection member 47 to be connected to the flow channel 50*a* is attached to the introduction port 51*a* of the flow channel member 42*a*.

Figure 11C:
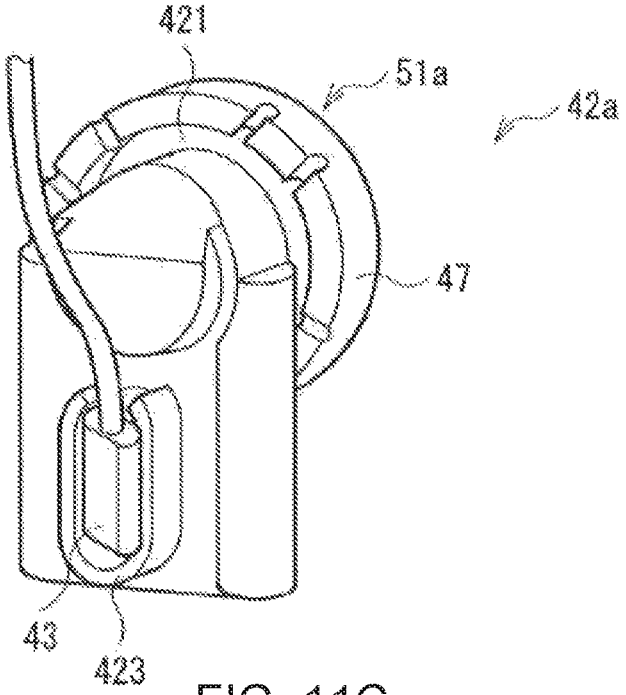
FIG. 11C is a cross-sectional view showing a process following the process shown in FIG. 11B.
Figure 11D:
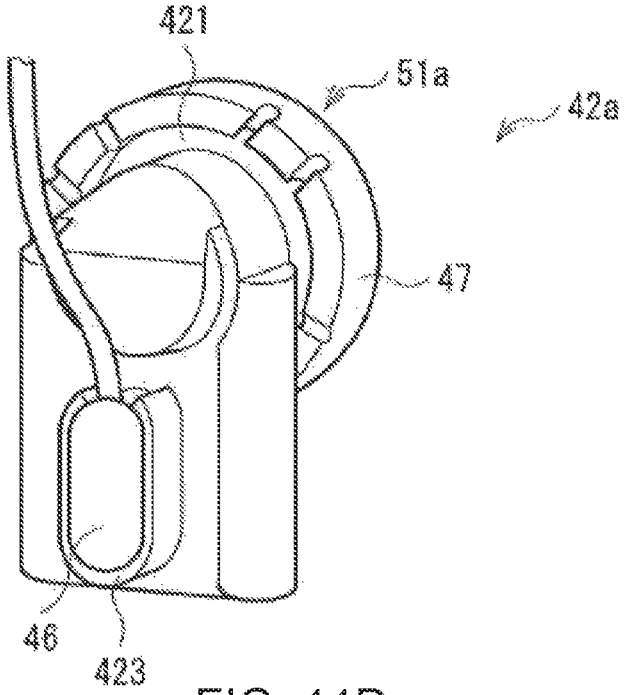
FIG. 11D is a cross-sectional view showing a process following the process shown in FIG. 11C.

After applying the first adhesive 45, the temperature detection element 43 is fixed to the high heat conduction part 422 with the first adhesive 45 as shown in FIG. 11C. Subsequently, as shown in FIG. 11D, the temperature detection element 43 is covered with the second adhesive 46. In such a manner as described above, the temperature detection element 43 is attached to the flow channel member 42*a*.

[Operations and Functions/Advantages]

(A. Basic Operation of Printer 1)

In the printer 1, a recording operation (a printing operation) of images, characters, and so on to the recording paper P is performed in the following manner. It should be noted that as an initial state, it is assumed that the four types of ink tanks 3 (3Y, 3M, 3C, and 3B) shown in FIG. 1 are sufficiently filled with the ink 9 of the corresponding colors (the four colors), respectively. Further, there is achieved the state in which the inkjet heads 4 are filled with the ink 9 in the ink tanks 3 via the circulation mechanism 5, respectively.

In such an initial state, when operating the printer 1, the grit rollers 21 in the carrying mechanisms 2*a*, 2*b* rotate to thereby carry the recording paper P along the carrying direction d (the X-axis direction) between the grit rollers 21 and the pinch rollers 22. Further, at the same time as such a carrying operation, the drive motor 633 in the drive mechanism 63 respectively rotates the pulleys 631*a*, 631*b* to thereby operate the endless belt 632. Thus, the carriage 62 reciprocates along the width direction (the Y-axis direction) of the recording paper P while being guided by the guide rails 61*a*, 61*b*. Then, on this occasion, the four colors of ink 9 are appropriately ejected on the recording paper P by the respective inkjet heads 4 (4Y, 4M, 4C, and 4B) to thereby perform the recording operation of images, characters, and so on to the recording paper P.

(B. Detailed Operation in Inkjet Heads 4)

Then, the detailed operation (the jet operation of the ink 9) in the inkjet heads 4 will be described with reference to FIG. 1 and FIG. 3. Specifically, in the inkjet heads 4 according to the present embodiment, the jet operation of the ink 9 using a shear mode is performed in the following manner.

Firstly, when the reciprocation of the carriage 62 (see FIG. 1) described above is started, the drive circuit applies the drive voltage to the drive electrodes Ed in the inkjet head 4 (the head chip 41). Specifically, the drive circuit applies the drive voltage to the drive electrodes Ed disposed on the pair of drive walls Wd partitioning the ejection channel C1*e*. Thus, the pair of drive walls Wd each deform (see FIG. 3) so as to protrude toward the dummy channel C1*d* adjacent to the ejection channel C1*e*.

Here, as described above, in the actuator plate 412, the polarization direction differs along the thickness direction (the two piezoelectric substrates described above are stacked on one another), and at the same time, the drive electrodes Ed are formed in the entire area in the depth direction on the inner side surface in each of the drive walls Wd. Therefore, by applying the drive voltage using the drive circuit described above, it results that the drive wall Wd makes a flexion deformation to have a V shape centered on the intermediate position in the depth direction in the drive wall Wd. Further, due to such a flexion deformation of the drive wall Wd, the ejection channel C1*e*, C2*e* deforms as if the ejection channel C1*e*, C2*e* bulges.

In the case in which the configuration of the actuator plate 412 is not the chevron type but is the cantilever type described above, the drive wall Wd makes the flexion deformation to have the V shape in the following manner. That is, in the case of the cantilever type, since it results that the drive electrode Ed is attached by the oblique evaporation to an upper half in the depth direction, by the drive force exerted only on the part provided with the drive electrode Ed, the drive wall Wd makes the flexion deformation (in the end part in the depth direction of the drive electrode Ed). As a result, even in this case, since the drive wall Wd makes the flexion deformation to have the V shape, it results that the ejection channel C1*e*, C2*e* deforms as if the ejection channel C1*e*, C2*e* bulges.

As described above, due to the flexion deformation caused by a piezoelectric thickness-shear effect in the pair of drive walls Wd, the capacity of the ejection channel C1*e* increases. Further, by increasing the capacity of the ejection channel C1*e*, the ink 9 in an ink introduction hole in the cover plate 413 described above is induced into the ejection channel C1*e* via the slit as a result (see FIG. 4).

Subsequently, the ink 9 having been induced into the ejection channel C1*e* in such a manner turns to a pressure wave to propagate to the inside of the ejection channel C1*e*. Then, the drive voltage to be applied to the drive electrodes Ed becomes 0 (zero) V at the timing at which the pressure wave has reached the nozzle hole H1 of the nozzle plate 411. Thus, the drive walls are restored from the state of the flexion deformation described above, and as a result, the capacity of the ejection channel C1*e* having once increased is restored again.

When the capacity of the ejection channel C1*e* is restored in such a manner, the internal pressure of the ejection channel C1*e* increases, and the ink 9 in the ejection channel C1*e* is pressurized. As a result, the ink 9 having a droplet shape is ejected toward the outside (toward the recording paper P) through the nozzle hole H1. The jet operation (the ejection operation) of the ink 9 in the inkjet head 4 is performed in such a manner, and as a result, the recording operation of images, characters, and so on to the recording paper P is performed.

(C. Functions/Advantages)

In the present embodiment, the high heat conduction part 422 is provided to the flow channel member 42*a*, and the temperature detection element 43 is attached to the outer surface of the high heat conduction part 422. Thus, the temperature of the ink 9 flowing inside the flow channel member 42*a* is detected via the high heat conduction part 422. Therefore, the temperature of the ink 9 flowing inside the flow channel member 42*a* can accurately be detected. Hereinafter, this point will be described in detail.

For example, it is conceivable to adopt a method of disposing the temperature detection element inside the flow channel of the ink to thereby make the temperature detection element have direct contact with the ink. However, since the temperature detection element is corroded depending on the component of the ink, this method requires a special temperature detection element. The special temperature detection element denotes a temperature detection element having high corrosion resistance. Therefore, the cost necessary for the temperature detection element rises. Further, even if the special temperature detection element is used, there is a possibility that the temperature detection element having direct contact with the ink is corroded depending on the component included in the ink.

In contrast, in the case of disposing the temperature detection element outside the component provided with the flow channel disposed inside, there is a possibility that the sensitivity of the temperature detection element is blunted due to the constituent material, the thickness and so on of the component to fail to accurately detect the temperature of the ink. Further, the constituent material of the component is significantly limited, or it is necessary to form a special pattern in order to detect the temperature (see, e.g., PLT 1).

In contrast, in the inkjet head 4 according to the present embodiment, the high heat conduction part 422 is provided to the flow channel member 42*a* having the flow channel of the ink 9 inside, and the temperature detection element 43 is attached to the outer surface of the high heat conduction part 422. Specifically, since the inner surface of the high heat conduction part 422 has contact with the ink 9, and the temperature detection element 43 is disposed on the outer surface of the high heat conduction part 422, the temperature detection element 43 detects the temperature of the ink 9 via the high heat conduction part 422 without having direct contact with the ink 9. Therefore, nothing special is required to be used as the temperature detection element 43, and it is possible to suppress the increase in cost necessary for the temperature detection element 43. Further, the corrosion of the temperature detection element 43 can also be prevented. Further, the constituent material of the high heat conduction part 422 can more freely be selected, and further, the formation of the special pattern is not required.

In addition, since the thermal conductivity of the high heat conduction part 422 is higher than the thermal conductivity of the low heat conduction part 421, the temperature detection element 43 detects the temperature of the ink 9 with higher sensitivity. As described above, it is possible for the temperature detection element 9 to accurately detect the temperature of the ink 9 flowing inside the flow channel member 42*a* without having direct contact with the ink 9.

As described above, since in the inkjet head 4 according to the present embodiment, it is arranged that the high heat conduction part 422 is provided to the flow channel member 42*a* and the temperature detection element 43 is attached to the outer side of the high heat conduction part 422, it becomes possible to suppress the increase in cost, and at the same time, to accurately detect the temperature of the ink 9 flowing inside the flow channel member 42*a*. Since it is possible to perform the precise temperature management of the ink 9 by accurately detecting the temperature of the ink 9 introduced into the head chip 41, it becomes possible to control the speed of the ink 9 ejected from the nozzle hole H1, H2 to improve the ejection quality.

Further, since the part of the temperature detection element 43 other than the bonding surface with the high heat conduction part 422 is covered with the second adhesive 46, it is possible to reduce the influence of the environmental temperature on the detection temperature of the temperature detection element 43.

Further, the temperature detection element 43 is disposed in the pocket-like housing section surrounded by the wall part 423, and is therefore stably fixed to the flow channel member 42*a*. Further, the leakage of the first adhesive 45 for fixing the temperature detection element 43 to the high heat conduction part 422 is also prevented. In addition, since the wall part 423 is formed of the low heat conduction part 421, it is possible to further reduce the influence of the environmental temperature on the detection temperature of the temperature detection element 43.

Further, since the flow channel member 42*a* to which the temperature detection element 43 is attached is disposed on the introduction port 51*a* side of the ink 9, it is possible to more accurately detect the temperature of the ink 9 without being affected by the temperature variation of the ink 9 in the head chip 41. Since the head chip 41 generates heat when being driven, the temperature of the ink 9 having flowed in the head chip 41 is apt to be affected by the heat generation. Therefore, by disposing the temperature detection element 43 on the introduction port 51*a* side, the temperature of the ink 9 is more accurately detected compared to the case of disposing the temperature detection element 43 on the discharge port 51*b* side.

2. MODIFIED EXAMPLES

The present disclosure is hereinabove described using the embodiment, but the disclosure is not limited to the embodiment, and a variety of modifications can be adopted.

For example, in the embodiment described above, the description is presented specifically citing the configuration examples (the shapes, the arrangements, the number and so on) of each of the members in the printer, the inkjet head and the head chip, but what is described in the above embodiment is not a limitation, and it is possible to adopt other shapes, arrangements, numbers and so on. Further, the values or the ranges, the magnitude relation and so on of a variety of parameters described in the above embodiment are not limited to those described in the above embodiment, but can also be other values or ranges, other magnitude relation and so on.

Specifically, the shape, the configuration and so on of the flow channel member 42*a* described in the above embodiment are not limited to those described in the above embodiment and so on, but can also be other shapes, configurations and so on. For example, in the embodiment described above, there is described the example in which the constituent material of the low heat conduction part 421 and the constituent material of the high heat conduction part 422 are different from each other, but it is also possible to adopt a configuration in which the constituent material of the low heat conduction part 421 and the constituent material of the high heat conduction part 422 are the same, and the thickness is made different between the low heat conduction part 421 and the high heat conduction part 422.

Further, the temperature detection element 43 is not required to be disposed in the area surrounded by the wall part 423, and it is not required to provide the wall part 423 to the flow channel member 42*a*. It is also possible to arrange that the temperature detection element 43 is fixed to the flow channel member 42*a* using other methods than bonding (with the first adhesive 45). It is also possible to omit the second adhesive 46 for covering the temperature detection element 43.

Further, in the embodiment described above, there is described the case of providing the introduction port 51*a* to the flow channel member 42*a*, but it is sufficient for the flow channel member 42*a* to be provided to the flow channel between the introduction port 51*a* and the liquid jet section. Specifically, it is sufficient for the flow channel member 42*a* to be disposed between the introduction port 51*a* and the introduction flow channel 441*a*, 441*b* of the flow channel plate 44.

Further, it is also possible to provide the low heat conduction part and the high heat conduction part to the flow channel member 42*b*, and to attach the temperature detection element 43 to the high heat conduction part of the flow channel member 42*b*. It is also possible to arrange that the flow channel member 42*b* to which the temperature detection element 43 is attached is provided to the flow channel of the ink 9 between the flow channel plate 44 (the discharge flow channel 442*a*, 442*b*) and the discharge port 51*b*.

Further, for example, in the embodiment described above, the cross-sectional shape of each of the nozzle holes H1, H2 is not limited to the circular shape as described in the above embodiment, but can also be, for example, an elliptical shape, a polygonal shape such as a triangular shape, or a star shape.

Further, in the above embodiment, the description is presented citing the printer 1 (the inkjet printer) as a specific example of the "liquid jet recording device" in the present disclosure, but this example is not a limitation, and it is also possible to apply the present disclosure to other devices than the inkjet printer. In other words, it is also possible to arrange that the "liquid jet head" (the inkjet head 4) of the present disclosure is applied to other devices than the inkjet printer. Specifically, for example, it is also possible to arrange that the "liquid jet head" of the present disclosure is applied to a device such as a facsimile or an on-demand printer.

In addition, it is also possible to apply the variety of examples described hereinabove in arbitrary combination.

It should be noted that the advantages described in the specification are illustrative only but are not a limitation, and another advantage can also be provided.

The present disclosure may be embodied as described below.

<1>

A liquid jet head comprising a flow channel member provided with a flow channel of a liquid, and having a high heat conduction part disposed so as to have contact with the liquid flowing inside the flow channel, and a low heat conduction part having lower thermal conductivity than thermal conductivity of the high heat conduction part; a temperature detection element disposed outside the flow channel, and attached to the high heat conduction part; and a liquid jet section from which the liquid is jetted.

<2>

The liquid jet head according to <1>, further comprising an introduction port disposed so as to be communicated with the flow channel, and adapted to supply the liquid to the liquid jet section, wherein the flow channel member is disposed between the introduction port and the liquid jet section.

<3>

The liquid jet head according to <1> or <2>, further comprising a first adhesive adapted to fix the temperature detection element to the high heat conduction part; and a second adhesive having lower thermal conductivity than thermal conductivity of the first adhesive, and having contact with at least a part of the temperature detection element other than a part bonded to the high heat conduction part.

<4>

The liquid jet head according to any one of <1> to <3>, wherein the low heat conduction part includes a wall part erected so as to surround the high heat conduction part.

<5>

The liquid jet head according to any one of <1> to <4>, wherein the low heat conduction part includes a resin material, and the high heat conduction part includes a metal material.

<6>

The liquid jet head according to any one of <1> to <5>, wherein the low heat conduction part is formed of PPS (poly phenylene sulfide), and the high heat conduction part is formed of a stainless steel material.

<7>

The liquid jet head according to any one of <1> to <6>, wherein the low heat conduction part and the high heat conduction part are formed integrally.

<8>

A liquid jet recording device comprising the liquid jet head according to any one of <1> to <7>.

What is claimed is:

1. A liquid jet head comprising:

a flow channel member provided with a flow channel of a liquid, and having a high heat conduction part disposed so as to have contact with the liquid flowing inside the flow channel, and a low heat conduction part having lower thermal conductivity than thermal conductivity of the high heat conduction part;

a temperature detection element disposed outside the flow channel, and attached to the high heat conduction part;

a liquid jet section from which the liquid is jetted;

a first adhesive adapted to fix the temperature detection element to the high heat conduction part; and a second adhesive having lower thermal conductivity than thermal conductivity of the first adhesive, and having contact with at least a part of the temperature detection element other than a part bonded to the high heat conduction part.

2. The liquid jet head according to claim 1, further comprising an introduction port disposed so as to be communicated with the flow channel, and adapted to supply the liquid to the liquid jet section, wherein the flow channel member is disposed between the introduction port and the liquid jet section.

3. The liquid jet head according to claim 1, wherein the low heat conduction part includes a wall part erected so as to surround the high heat conduction part.

4. The liquid jet head according to claim 1, wherein the low heat conduction part includes a resin material, and the high heat conduction part includes a metal material.

5. The liquid jet head according to claim 1, wherein the low heat conduction part is formed of PPS (poly phenylene sulfide), and the high heat conduction part is formed of a stainless steel material.

6. The liquid jet head according to claim 1, wherein the low heat conduction part and the high heat conduction part are formed integrally.

7. A liquid jet recording device comprising the liquid jet head according to claim 1.

* * * * *